US006787276B2

(12) United States Patent
Black et al.

(10) Patent No.: US 6,787,276 B2
(45) Date of Patent: Sep. 7, 2004

(54) DUAL LAYER PHOTOCONDUCTORS WITH CHARGE TRANSPORT LAYER INCLUDING STYRENE-ACRYLIC RESIN

(75) Inventors: David Glenn Black, Boulder, CO (US); Ronald Harold Levin, Boulder, CO (US); Dat Quoc Nguyen, Weld County, CO (US); Bradford Lee Taylor, Boulder, CO (US); Vincent Wen-Hwa Ting, Boulder, CO (US); Franklin Dilworth Zartman, Larimer, CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/176,192

(22) Filed: Jun. 20, 2002

(65) Prior Publication Data

US 2003/0235770 A1 Dec. 25, 2003

(51) Int. Cl.[7] ..... G03G 5/05

(52) U.S. Cl. ..... 430/58.4; 430/58.35; 430/59.6; 430/59.5; 430/59.4; 430/96; 524/502; 524/513; 524/537; 524/539; 524/543

(58) Field of Search ..... 430/96, 58.35, 430/59.6, 59.4, 59.5, 58.4; 514/502, 513, 537, 539, 543

(56) References Cited

U.S. PATENT DOCUMENTS

| | | | | | |
|---|---|---|---|---|---|
| 3,708,555 | A | | 1/1973 | Gaylord | |
| 4,788,118 | A | * | 11/1988 | Takaoka et al. | 430/49 |
| 4,829,106 | A | | 5/1989 | Holoch et al. | |
| 4,968,578 | A | * | 11/1990 | Light et al. | 430/126 |
| 4,994,121 | A | * | 2/1991 | Sobata et al. | 148/251 |
| 5,060,014 | A | | 10/1991 | Adachi et al. | |
| 5,324,454 | A | * | 6/1994 | Takata et al. | 524/504 |
| 5,485,250 | A | * | 1/1996 | Kashimura et al. | 399/116 |
| 5,972,549 | A | | 10/1999 | Levin et al. | |
| 5,994,014 | A | | 11/1999 | Hinch et al. | |
| 2002/0182520 | A1 | * | 12/2002 | Torikoshi | 430/18 |

FOREIGN PATENT DOCUMENTS

| | | | | |
|---|---|---|---|---|
| JP | 57004051 A | * | 1/1982 | |
| JP | 04263264 A | * | 9/1992 | G03G/5/06 |
| JP | 07319176 A | * | 12/1995 | G03G/5/04 |

OTHER PUBLICATIONS

English translation of JP 57–4051 (1/82).*

Borsenberger, Paul et al. Organic Photoreceptors for Imaging Systems. New York: Marcel–Dekker, Inc. (1993) pp. 338–368.*

Chemical Abstracts 97:14787 (2004).*

Chemical Abstracts 124:160341 (2003).*

* cited by examiner

*Primary Examiner*—Christopher Rodee
(74) *Attorney, Agent, or Firm*—John A. Brady

(57) ABSTRACT

Charge transport layers comprise a charge transport compound and binder including styrene-acrylic resin. Dual layer photoconductors comprise a substrate, a charge transport layer as described, and a charge generation layer.

14 Claims, No Drawings

DUAL LAYER PHOTOCONDUCTORS WITH CHARGE TRANSPORT LAYER INCLUDING STYRENE-ACRYLIC RESIN

FIELD OF THE INVENTION

The present invention is directed to dual layer photoconductors which comprise a charge transport layer and a charge generation layer formed on a substrate. More particularly, the invention is directed to such dual layer photoconductors wherein the charge transport layer comprises binder including styrene-acrylic resin which provides the photoconductor with improved resistance to non-uniform wear, including scratching and gouging.

BACKGROUND OF THE INVENTION

In electrophotography, a latent image is created on the surface of an imaging member such as a photoconducting material by selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner.

Although organic electrophotographic photoconductors may be of single layer construction, many organic photoconductors have a dual layer construction. Dual layer photoconductors typically comprise a substrate such as a metal ground plane member on which a charge generation layer and a charge transport layer are coated. When the charge transport layer is formed on the charge generation layer, the photoconductor exhibits a negative charge on its surface. Conversely, when the charge generation layer is formed on the charge transport layer, the photoconductor exhibits a positive charge on the surface. Conventionally, the charge generation layer comprises a polymeric binder containing a charge generating compound or molecule while the charge transport layer comprises a polymeric binder containing a charge transport compound or molecule. The charge generating compounds within the charge generation layer are sensitive to image-forming radiation and photogenerate free electron-hole pairs within the charge generation layer as a result of such radiation. The charge transport layer is usually non-absorbent of the image-forming radiation and the charge transport compounds serve to transport holes to the surface of the photoconductor. Photoconductors of this type are disclosed in the Adley et al U.S. Pat. No. 5,130,215 and the Balthis et al U.S. Pat. No. 5,545,499.

One problem associated with some organic photoconductors is that their wear performance is generally inferior to that of inorganic photoconductors, such as amorphous silicon. Photoreceptor wear in the print area is either roughly uniform or non-uniform in nature. This latter wear mechanism often appears as gouges or scratches on the photoreceptor surface, which may manifest themselves as defects in the printed product. Even thin scratches can result in a general print lightning when present in a sufficient density, or they can result in thicker printed areas when printing in duplex mode. Photoreceptor surface scratches may appear due to several factors which include: (1) interaction of an abrasive toner with the cleaning blade and the organic photoconductor surface; and/or (2) interaction of paper with the organic photoconductor surface. The abrasive components of the toner are key contributors to the level of scratching: common toner additives such as silicon carbide are extremely hard, and thus more prone to scratch the photoconductor surface.

A known approach to decreasing the wear and scratching of an organic photoconductor is to provide an additional hardened overcoating which is designed to make the organic photoconductor harder and thus more wear resistant. This additional layer, however, adds additional expense and an additional manufacturing step. Consequently, a need exists for providing organic photoconductors that exhibit improved wear characteristics without adversely affecting the electrical properties of the photoconductor or significantly increasing cost or manufacturing complexity of the photoconductors.

SUMMARY OF THE INVENTION

Accordingly, it is an object of the present invention to provide improved photoconductors and improved charge transport layers for use in photoconductors. More particularly, it is an object of the present invention to provide charge transport layers and dual layer photoconductors which exhibit improved resistance to non-uniform wear, for example scratching and gouging, which may detract from printed images, while maintaining good electrical performance and acceptable durability.

These and additional objects and advantages are provided by the charge transport layers and the dual layer photoconductors according to the present invention. The charge transport layers according to the invention comprise charge transport compound and binder including styrene-acrylic resin. The photoconductors according to the present invention comprise a substrate, a charge generation layer and a charge transport layer, wherein the charge transport layer comprises charge transport compound and binder including styrene-acrylic resin. In another embodiment, photoconductors according to the present invention comprise a substrate; a charge generation layer formed on the substrate and comprising charge generation compound and charge generation layer binder, wherein the charge generation compound comprises titanylphthalocyanine; and c) a charge transport layer formed on the charge generation layer and comprising charge transport compound and binder including polycarbonate and styrene-acrylic resin, wherein the charge transport compound comprises a hydrazone compound, and wherein the styrene-acrylic resin is present in an amount sufficient to improve non-uniform wear resistance of the charge transport layer.

Styrene-acrylic resins, especially those containing a high percentage of styrene, are well known as soft polymers. Surprisingly, the addition of such a soft polymer resin to the charge transport layer of an organic photoconductor decreases or eliminates non-uniform wear such as scratching or gouging on the photoconductor surface. Furthermore, the dual layer photoconductors according to the present invention are advantageous in that they exhibit good electrical performance, including good sensitivity and/or good residual voltage.

These and additional objects and advantages will be further apparent in view of the following detailed description.

DETAILED DESCRIPTION

The charge transport layers according to the present invention comprise charge transport compound and binder including styrene-acrylic resin. The dual layer photoconductors according to the present invention comprise a substrate, a charge generation layer and a charge transport layer. The charge transport layer comprises charge transport compound and binder including styrene-acrylic resin. The charge generation layer typically comprises charge generating compound and binder.

The photoconductor substrate may be flexible, for example in the form of a flexible web or a belt, or inflexible, for example in the form of a drum. Typically, the photoconductor substrate is uniformly coated with a thin layer of a metal, which functions as an electrical ground plate. In one embodiment, this metal layer is aluminum. In a further embodiment, the aluminum is anodized to convert the aluminum surface into a thicker aluminum oxide surface. Alternatively, the ground plane member may comprise a metallic plate, such as aluminum or nickel, a metallic drum or foil, or a plastic film on which aluminum, tin oxide or indium oxide or the like is vacuum evaporated.

Typically the charge generation layer may be formed on the photoconductor substrate, followed by formation of the charge transport layer, whereby the photoconductor surface exhibits a negative charge and the non-uniform wear resistance benefits of the charge transport layer are maximized.

The charge transport layer included in the dual layer photoconductors according to the present invention comprises charge transport compound and binder including styrene-acrylic resin. The charge transport layer may include one or more of any of the charge transport compounds generally known in the art for use in charge transport layers. Charge transport compounds suitable for use in the charge transport layer of the photoconductors of the present invention should be capable of supporting the injection of photogenerated holes and electrons from the charge generation layer and allowing the transport of these holes or electrons through the charge transport layer to selectively discharge the surface charge. Suitable charge transport compounds for use in the charge transport layer include, but are not limited to, the following:

1. Diamine and triarylamine transport molecules of the types described in U.S. Pat. Nos. 4,306,008, 4,304,829, 4,233,384, 4,115,116, 4,299,897, 4,265,990 and/or 4,081,274. Typical diamine transport molecules include N,N'-diphenyl-N,N'-bis(alkylphenyl)-[1,1'-biphenyl]-4,4'-diamines wherein the alkyl is, for example, methyl, ethyl, propyl, n-butyl, or the like, or halogen substituted derivatives thereof, commonly referred to as benzidine and substituted benzidine compounds, and the like. Typical triarylamines include, for example, tritolylamine, and the like.

2. Pyrazoline transport molecules as disclosed in U.S. Pat. Nos. 4,315,982, 4,278,746 and 3,837,851. Typical pyrazoline transport molecules include 1-[lepidyl-(2)]-3-(p-diethylaminophenyl)-5-p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl) pyrazoline, 1-phenyl-3-[p-diethylaminostyryl]-5-(p-dimethylaminostyryl)pyrazoline, 1-phenyl-3-[p-diethylaminostyryl]-5-(p-diethylaminostyryl) pyrazoline, and the like.

3. Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2,4'-dimethoxybenzylidene)fluorene, 2-nitro-9-benzylidene-fluorene, 2-nitro-9-(4'-diethylaminobenzylidene)fluorene and the like.

4. Oxadiazole transport molecules such as 2,5-bis(4-diethylaminophenyl)-1,3,4-oxadiazole, imidazole, triazole, and others as described in German Patents Nos. 1,058,836, 1,060,260 and 1,120,875 and U.S. Pat. No. 3,895,944.

5. Hydrazone transport molecules including p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example, in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example, in U.S. Pat. Nos. 4,385,106, 4,338,388, 4,387,147, 4,399,208 and 4,399,207. Yet other hydrazone charge transport molecules include carbazole phenyl hydrazones such a 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426. Hydrazone transport molecules, suitable for use in the charge transport layer, include derivatives of aminobenzaldehydes, cinnamic esters or hydroxylated benzaldehydes. Exemplary amino benzaldehyde-derived hydrazones include those set forth in the Anderson et al U.S. Pat. Nos. 4,150,987 and 4,362,798, while exemplary cinnamic ester-derived hydrazones and hydroxylated benzaldehyde-derived hydrazones are set forth in the copending Levin et al U.S. application Ser. No. 08/988,600 and U.S. Pat. No. 5,925,486, respectively, all of which patents and applications are incorporated herein by reference.

In a specific embodiment, the charge transport compound is selected from the group consisting of diamine transport compounds, pyrazoline transport compounds, substituted fluorine transport compounds, hydrazone transport compounds, and mixtures thereof. In a further embodiment, the charge transport compound included in the charge transport layer comprises a hydrazone, an aromatic amine (including aromatic diamines), a substituted aromatic amine (including substituted aromatic diamines), or a mixture thereof. In yet a further embodiment, the charge transport compound comprises a hydrazone transport compound.

The charge transport layer typically comprises charge transport compound in an amount of from about 5 to about 60 weight percent, based on the weight of the charge transport layer. In a more specific embodiment, the charge transport layer comprises charge transport compound in an amount of from about 15 to about 40 weight percent, based on the weight of the charge transport layer, with the remainder of the charge transport layer typically comprising the binder including styrene-acrylic resin, although other additional components conventionally employed in charge transport layers may be included therein. Thus, the charge transport layer may comprise from about 40 to about 95 weight percent of the binder and, in a more specific embodiment, may comprise from about 60 to about 85 weight percent of the binder.

Typically, the polymeric binder of the charge transport layer should be inactive, i.e., not exhibiting charge transporting properties. In one embodiment, the binder of the charge transport layer comprises, in addition to the styrene-acrylic resin, a resin exhibiting a hardness greater than the hardness of the styrene-acrylic resin. In another embodiment, the binder is polymeric and, in addition to styrene-acrylic resin, may comprise, but is not limited to, polycarbonate polymers and copolymers, including polyestercarbonates, vinyl polymers such as polyvinyl chloride, polyvinyl butyryl, polyvinyl acetate, other styrene polymers, and copolymers of these vinyl polymers, other acrylic acid and acrylate polymers and copolymers, polyesters, alkyd resins, polyamides, polyurethanes, epoxy resins and the like. In a specific embodiment, the binder comprises polycarbonate in combination with the styrene-acrylic resin.

The styrene-acrylic resin included in the binder of the charge transport layers of the present invention comprises a copolymer of styrene monomer and acrylic monomer. The term "styrene monomer" as used herein includes all aromatic vinyl monomers, including but not limited to, styrene and substituted styrene including one or more substituents such as alkyl, alkoxy, halogen, and the like. Suitable alkyl and alkoxy substituents may include, for example, 1 to 10 carbon atoms. The term "acrylic monomer" as used herein includes acrylic acids, such as acrylic acid and/or methacrylic acid and alkyl acrylate esters thereof, including but not limited to ethyl acrylate, butyl acrylate, methyl acrylate, butyl methacrylate, ethyl methacrylate, methyl methacrylate and the like. Alkyl groups may include, for example, 1 to 10 carbon atoms. In a more specific embodiment, the styrene-acrylic resin is formed from styrene monomer and butyl acrylate monomer.

The styrene-acrylic resin typically comprises from about 5% to about 95% styrene monomer units, by weight, and from about 5% to about 95% acrylic monomer units, by weight. In a more specific embodiment, the styrene-acrylic resin comprises from about 50% to about 90% styrene monomer units, and from about 10% to about 50% acrylic monomer units. In a further embodiment, the styrene-acrylic resin comprises from about 60% to about 90% styrene monomer units, and from about 10% to about 40% acrylic monomer units.

In one embodiment, the styrene-acrylic resin has a high molecular weight, or a weight average molecular weight of at least about 250,000. In a further embodiment, the styrene-acrylic resin has a weight average molecular weight of at least about 1,000,000. The only upper limit to the molecular weight of the styrene-acrylic resin is the molecular weight at which the resin is no longer soluble in a solvent commonly used to form charge transport layers, for example, tetrahydrofuran. In a further embodiment, the styrene-acrylic resin is a monomodal polymer.

In another embodiment, the styrene-acrylic resin has about a 0% gel content, thereby indicating that the material is not measurably cross-linked. Consequently, solubility of the resin and subsequent coating of the charge transport layer upon the charge generation layer are thus facilitated.

In yet another embodiment, the styrene-acrylic resin has an acid content less than about 0.5%, based on the weight of the resin. In a more specific embodiment, the styrene-acrylic resin has an acid content less than about 0.2%, based on the weight of the resin. In yet a more specific embodiment, the styrene-acrylic resin has an acid content less than about 0.1%, based on the weight of the resin. The acid content of the resin may be determined by titration in methanol using KOH as a base and phenylthaline as an indicator, in accordance with well-known techniques.

The binder of the charge transport layer may include the styrene-acrylic resin in any desired amount. In one embodiment, the charge transport layer binder includes the styrene-acrylic resin an amount sufficient to improve the non-uniform wear of the layer. Improvement in non-uniform wear may be evaluated in terms of improved scratch resistance and/or improved gouge resistance of the charge transport layer. In a further embodiment, the charge transport layer comprises from about 1% to about 15% of the styrene-acrylic resin, by weight of the charge transport layer. In yet a further embodiment. the charge transport layer comprises from about 1% to about 10% of the styrene-acrylic resin, by weight of the charge transport layer.

While not wishing to be bound by theory, it is believed that the styrene-acrylic separates into spherical domains, and that regions of soft styrene-acrylic and harder polycarbonate may contribute to improved scratching resistance.

As set forth above, the charge generation layer may comprise charge generating compound and binder. Various charge generation compounds which are known in the art are suitable for use in the charge generation layer of the photoconductors according to the present invention. Organic charge generation compounds are suitable for use in the present photoconductors, examples of which include, but are not limited to, disazo compounds, for example as disclosed in the Ishikawa et al U.S. Pat. No. 4,413,045, tris and tetrakis compounds as known in the art, phthalocyanine dyes, including both metal-free forms such as X-form metal-free phthalocyanines and the metal-containing phthalocyanines such as titanium-containing phthalocyanines as disclosed in U.S. Pat. Nos. 4,664,997, 4,725,519 and 4,777,251, polymorphs and derivatives thereof, and squaric acid-derived dyes, for example hydroxy-squaraine charge generation compounds. In one embodiment, the charge generation compound is selected from the group consisting of disazo compounds, tris and tetrakis compounds, phthalocyanine dyes, polymorphs and derivatives thereof, squaric acid-derived dyes, and mixtures thereof.

In a more specific embodiment, the charge generation compound for use in the charge generation layer according to the present invention comprises metal-containing phthalocyanines, and more particularly metal-containing phthalocyanines wherein the metal is a transition metal or a group IIIA metal. In a further embodiment, the charge generation compound comprises metal-containing phthalocyanine containing a transition metal such as copper, titanium or manganese or containing aluminum as a group IIIA metal. The metal-containing phthalocyanine charge generation compound optionally may be oxy, thiol or dihalo substituted. In yet a further embodiment, the charge generation compound comprises a titanylphthalocyanine. In yet a further embodiment, charge generation compounds in the charge generation layer comprise titanylphthalocyanines, including various polymorphs thereof, for example type IV polymorphs, and derivatives thereof, for example halogen-substituted derivatives such as chlorotitanyl phthalocyanines.

The charge generating compounds are employed in the charge generation layer in conventional amounts suitable for providing the charge generation effects. In one embodiment, the charge generation layer comprises charge generation compound in an amount of from about 10% to about 90%, by weight of the charge generation layer. In another embodiment, the charge generation layer comprises charge generation compound in an amount of from about 25% to about 80% by weight of the charge generation layer.

The polymeric binder of the charge generation layer may be any polymeric binder known in the art for use in charge generation layers. Typically, the binder of the charge generation layer should be inactive, i.e, not exhibiting either charge generation or charge transporting properties. The charge generation layer binder may comprise, but is not limited to, polycarbonate polymers and copolymers, including polyestercarbonates, vinyl polymers such as polyvinyl chloride, polyvinyl butyryl, polyvinyl acetate, styrene polymers, and copolymers of these vinyl polymers, acrylic acid and acrylate polymers and copolymers, polyesters, alkyd resins, polyamides, polyurethanes, epoxy resins and the like.

In another embodiment, the charge generation layer comprises the binder in an amount of from about 10% to about 90% by weight of the charge generation layer. In a further embodiment, the charge generation layer comprises the binder in an amount of from about 20% to about 75% by weight of the charge generation layer.

In a further specific embodiment, the photoconductor of the present invention comprises a substrate; a charge generation layer formed on the substrate and comprising charge generation compound and charge generation layer binder, wherein the charge generation compound comprises titanylphthalocyanine; and a charge transport layer formed on the charge generation layer and comprising charge transport compound and binder including polycarbonate and styrene-acrylic resin; wherein the charge transport compound comprises a hydrazone compound, and wherein styrene-acrylic resin is present in an amount sufficient to improve non-uniform wear resistance.

The photoconductor imaging members described herein may be prepared according to conventional techniques. Typically, the anodized layer of the aluminum photoconductor substrate will have a thickness of from about 3 microns to about 9 microns, the charge generation layer will have a thickness of from about 0.05 to about 5 microns, and the charge transport layer will have a thickness of from about 10 to about 35 microns. In accordance with techniques known in the art, a barrier layer may be provided between the ground plane and the charge generation layer, typically having a thickness of from about 0.05 to about 2.0 microns. The charge generation layer may be formed by dispersing the charge generating compound in a polymeric binder and solvent, coating the dispersion on the respective underlying layer and drying the coating. Similarly, the charge transport layer may be formed by dispersing the charge transport compound and a polymeric binder including styrene-acrylic resin in solvent, coating the dispersion on the respective underlying layer and drying the coating.

Various embodiments of the photoconductors according to the present invention are illustrated in the following examples. In the examples and throughout the present specification, parts and percentages are by weight unless otherwise specified.

EXAMPLE 1

In this example, a photoconductor A according to the invention and a comparative photoconductor B are prepared. Both photoconductors comprise dual layer photoconductors in which a charge generation layer is formed on an aluminum substrate using a dispersion prepared from the components set forth in Table 1.

TABLE 1

Charge Generation Formulation.

| Material | Weight Percent |
|---|---|
| TiOPC (titanylphthalocyanine) | 1.44 |
| PVB (polyvinylbuterol) | 0.88 |
| PMPS (polymethyl phenylsiloxane) | 0.72 |
| PSOH (polyhydroxystyrene) | 0.08 |
| MEK (methyl ethyl ketone) | 87.19 |
| Cyclohexanone | 9.69 |

Specifically, the charge generation dispersion described in Table 1 is coated over two cylindrical aluminum substrates and cured at 100° C. for 15 minutes. Charge transport formulations set forth in Tables 2 and 3 are then coated over the charge generation layer and cured at 100° C. for 1 hour to form photoconductor A according to the invention and comparative photoconductor B, respectively. The formulation detailed in Table 2 incorporates 5% styrene-acrylic resin, by weight of the solids. The formulation detailed in Table 3 incorporates 0% styrene-acrylic resin, by weight of the charge transport layer. Both formulations contain the same weight percentage of solids and of charge transport compound. The combined coat weight is approximately 20 mg/in$^2$.

TABLE 2

Charge Transport Formulation for Inventive Photoconductor A.

| Material | Weight Percent |
|---|---|
| DEH (diethylaminobenzaldehyde diphenylhydrazone) | 7.6 |
| Polycarbonate A | 11 |
| Oligomeric hindered phenol | 0.2 |
| Acetosol Yellow | 0.2 |
| THF (tetrahydrofuran) | 70 |
| Cyclopentanone | 10 |
| Styrene-acrylic resin | 1 |

TABLE 3

Charge Transport Formulation for Comparative Photoconductor B.

| Material | Weight Percent |
|---|---|
| DEH (diethylaminobenzaldehyde diphenylhydrazone) | 7.6 |
| Polycarbonate A | 12 |
| Oligomeric hindered phenol | 0.2 |
| Acetosol Yellow | 0.2 |
| THF (tetrahydrofuran) | 70 |
| Cyclopentanone | 10 |

The styrene-acrylic resin may comprise H-1347 (Sekisui Company). H-1347 is a styrene-butylacrylate resin, which comprises about 75% styrene and about 25% butylacrylate, by weight of the resin. The properties of this material are detailed in Table 4.

TABLE 4

| Properties of H-1347, styrene-butylacrylate | |
|---|---|
| Tg onset/, midpoint | 59° C./63° C. |
| % Gel | 0 |
| GPC MW and pattern | |
| Mp (peak MW) | 1 M |
| Mw | 1.4 M |
| Mn | 310 K |
| Mz | 3.2 M |
| MWD | 1.04 |
| Pattern | Narrow, monomodal |
| Rheology | |
| T1/T4 | 193° C./219° C. |
| Log Viscosity at 120° C. | 4.35 |
| Tan delta at 180° C. | 0.3 |

Various electrical characteristics of the photoconductors described in this example were examined. Dark decay (DD), which is the loss of charge from the surface of the photoconductor when it is maintained in the dark, was also measured. Dark decay is an undesirable feature as it reduces the contrast potential between image and background areas, leading to washed out images and loss of gray scale. Dark decay also reduces the field that the photoconductive process will experience when light is brought back to the surface, thereby reducing the operational efficiency of the photoconductor. Sensitivity measurements were made using an electrostatic sensitometer fitted with electrostatic probes to measure the voltage magnitude as a function of light energy shining on the photoconductor surface. The drum was charged by a corona and the expose-to-develop time for all measurements was 61 ms. The photosensitivity was measured as the discharge voltage on the photoconductor drum previously charged to about −850 V, measured at a light energy of 0.0 $\mu J/cm^2$, 0.20 $\mu J/cm^2$, and 1.00 $\mu J/cm^2$, respectively. Measurements were made to determine initial properties and after 1000 charge/discharge cycles. The results of all of these measurements are set forth in Table 5.

TABLE 5

Electrostatic Properties.

| Photoconductor | V@0.00 $\mu$J | V@0.20 $\mu$J | V@1.00, $\mu$J | DD, 1 sec | V@0.00 (1000) | V@0.20, $\mu$J (1000) | V@1.00 $\mu$J (1000) | DD, 1 sec (1000) |
|---|---|---|---|---|---|---|---|---|
| A | −850.87 | −344.63 | −271.66 | 26.86 | −853.40 | −335.76 | −270.55 | 40.33 |
| B | −857.45 | −333.43 | −256.68 | 21.14 | −861.56 | −325.46 | −248.18 | 33.55 |

The above results demonstrate that the initial electrical properties of photoconductor A comprising a binder including styrene-acrylic resin are similar to those of the comparative photoconductor B. In particular, the stability of photoconductor A at 1.0 $\mu$J after 1000 cycles is noted.

The photoconductors as described above are evaluated for scratch resistance and print count performance in Lexmark® Optra® T printers (modified to run at 40 ppm) in a four page and pause duplex mode. A relatively abrasive toner is used in this experiment. The scratch resistance evaluation is performed at the end of drum life after one toner refill, and print count is presented as the number of thousands of pages printed during the life of the photoconductor. The results are summarized in Table 6, using the following scale: 7, none; 6, extremely light; 5, light; 4, light to moderate; 3, moderate; 2, moderate to heavy; 1, heavy.

TABLE 6

Scratch Ratings and Print Count.

| Photoconductor | Scratch Rating | Print Count |
|---|---|---|
| A | 6.9 | 39.4 |
| B | 2.2 | 50.2 |

Table 6 shows that photoconductor A comprising a binder including styrene-acrylic resin exhibits improved scratch resistance and substantially reduced observed scratching. Specifically, the scratch rating of comparative photoconductor B was 2.2, between "moderate to heavy" (2) and "moderate" (3). In contrast, the scratch rating of inventive photoconductor A was 6.9, between extremely light (6) and none (7). While the print count for inventive photoconductor A was less than that of comparative photoconductor B, photoconductor A is still acceptable for practical use.

The hardness properties of the photoconductors A and B are examined via a Knoop hardness tester. The results are summarized in Table 7.

TABLE 7

Knoop Hardness.

| Photoconductor | Average | Standard Deviation |
|---|---|---|
| A | 19.02 | .68 |
| B | 20.39 | .45 |

The data shown above shows a statistical difference at the 95% confidence level. Although the Knoop hardness of the inventive photoconductor A is lower than that of the comparative photoconductor B, photoconductor A is still acceptable for practical use. The shorter life of styrene-acrylic containing photoconductors may be explained by the softer charge transport layer. The lower scratching level may also be explained by a higher wear rate, although the mechanism is unclear.

EXAMPLE 2

Additional photoconductors are prepared in this example. Photoconductor C according to the invention is prepared as described in Example 1, except that the charge transport layer is formed from a dispersion comprising 3 weight percent of the total solids. Total solids and the weight percentage of charge transport compound remain the same as described in Example 1. A comparative photoconductor D is prepared as described in Example 1. Lexmark® Optra T® printers (modified to run at 40 ppm) in a four page and pause duplex mode. Photoconductor scratch rating evaluation is performed at the end of one cartridge life. The results are summarized in Table 8 according to the following scratch rating scale described in Example 1: 7, none; 6, extremely light; 5, light; 4, light to moderate; 3, moderate; 2, moderate to heavy; 1, heavy.

TABLE 8

Summary of Drum Scratches as a Function of Styrene-Acrylic Level Toner Type.

| Photoconductor | Scratch Rating | |
|---|---|---|
| | More Abrasive Toner | Less Abrasive Toner |
| C | 5.0 | 6.5 |
| D | 1.8 | 3.3 |

The above summary shows that photoconductor C exhibits diminished scratches versus comparative photoconductor D.

The foregoing examples and various embodiments of the present invention set forth herein are provided for illustrative purposes only and are not intended to limit the scope of the invention defined by the claims. Additional embodiments of the present invention and advantages thereof will be apparent to one of ordinary skill in the art and are within the scope of the invention defined by the following claims.

What is claimed is:

1. A charge transport layer for a photoconductor, comprising charge transport compound and binder consisting essentially of polycarbonate resin and styrene-acrylic resin, said styrene-acrylic resin being in amount of about 1% to about 15% by weight of said charge transport layer, said styrene-acrylic resin being about 75% styrene and about 25% acrylate by weight and having a weight average molecular weight of at least about 1,000,000, wherein the charge transport compound is selected from the group consisting of diamine transport compounds, pyrazoline transport compounds, substituted fluorene transport compounds, hydrazone transport compounds, and mixtures thereof.

2. A charge transport layer for a photoconductor as defined by claim 1, comprising from about 1% to about 10% of the styrene-acrylic resin, by weight of the charge transport layer.

3. A charge transport layer for a photoconductor as defined by claim 1, wherein the styrene-acrylic resin has an acid content less than about 0.5%, based on the weight of the resin.

4. A charge transport layer for a photoconductor as defined by claim 1, wherein the styrene acrylic resin has an acid content less than about 0.2%, based on the weight of the resin.

5. A charge transport layer for a photoconductor as defined by claim 1, wherein the charge transport compound comprises a hydrazone transport compound.

6. A charge transport layer for a photoconductor as defined by claim 1, wherein the charge transport layer comprises from about 5% to about 60%, by weight of the charge transport layer, of the charge transport compound.

7. A charge transport layer for a photoconductor as defined by claim 1, wherein the charge transport layer comprises from about 15% to about 40%, by weight of the charge transport layer, of the charge transport compound.

8. A photoconductor comprising a substrate, a charge generation layer, and a charge transport layer, wherein the charge transport layer comprises charge transport compound and binder consisting essentially of polycarbonate resin and styrene-acrylic resin, said styrene-acrylic resin being in amount of about 1% to about 15% by weight of said charge transport layer, said styrene-acrylic resin being about 75% styrene and about 25% acrylate by weight and having weight average molecular weight of at least about 1,000,000.

9. A photoconductor as defined by claim 8, wherein the styrene-acrylic resin has an acid content less than about 0.5%, based on the weight of the resin.

10. A photoconductor as defined by claim 8, wherein the charge generation layer comprises charge generation compound and charge generation layer binder.

11. A photoconductor as defined by claim 10, wherein the charge generation compound is selected from the group consisting of disazo compounds, phthalocyanine dyes, polymorphs and derivatives thereof, squaric acid-derived dyes, and mixtures thereof.

12. A photoconductor as defined by claim 10, wherein the charge generation compound comprises metal-containing phthalocyanine wherein the metal is a transition metal or a group IIIA metal.

13. A photoconductor as defined by claim 10, wherein the charge generation compound comprises a titanylphthalocyanine.

14. A charge transport layer for a photoconductor, comprising charge transport compound and binder consisting essentially of polycarbonate resin and styrene-butylacrylate resin, said styrene-butylacrylate resin being in amount of about 1% to about 15% by weight of said charge transport layer, said styrene-butylacrylate resin being about 75% styrene and about 25% butylacrylate by weight and having a weight average molecular weight of at least about 1,000,000.

* * * * *